United States Patent [19]

Barrington

[11] 4,083,409

[45] Apr. 11, 1978

[54] FULL FLOW BYPASS VALVE

[75] Inventor: Burchus Q. Barrington, Duncan, Okla.

[73] Assignee: Halliburton Company, Duncan, Okla.

[21] Appl. No.: 792,654

[22] Filed: May 2, 1977

[51] Int. Cl.[2] ..... E21B 43/12

[52] U.S. Cl. ..... 166/320; 166/325; 166/334; 251/214

[58] Field of Search ..... 166/315, 320, 325, 334; 175/296, 297; 251/214

[56] References Cited

U.S. PATENT DOCUMENTS

| | | | |
|---|---|---|---|
| 3,087,559 | 4/1963 | Hazen et al. | 175/297 |
| 3,664,415 | 5/1972 | Wray et al. | 166/.5 |
| 3,750,752 | 8/1973 | Mott | 166/319 |
| 3,779,263 | 12/1973 | Edwards et al. | 166/315 |
| 3,850,250 | 11/1974 | Holden et al. | 166/315 |
| 3,856,085 | 12/1974 | Holden et al. | 166/324 |
| 3,964,544 | 6/1976 | Farley et al. | 166/315 |
| 3,970,147 | 7/1976 | Jessup et al. | 166/250 |
| 4,019,580 | 4/1977 | Garett | 166/315 |

*Primary Examiner*—James A. Leppink
*Attorney, Agent, or Firm*—John H. Tregoning

[57] ABSTRACT

A full flow bypass valve comprising mutually telescoping inner mandrel and outer housing members with hydraulic impedance means therebetween to provide a predetermined time delay when the members are relatively telescoped in a first direction and to provide substantially unrestricted relative telescoping movement between the members in the opposite direction. A valve mechanism provides simultaneous closure of bypass ports through the wall of the housing member when the mandrel and housing members reach full telescopic contraction. Pressure responsive means are provided for maintaining the bypass valve in a closed position regardless of internal or external pressures applied thereto.

17 Claims, 8 Drawing Figures

FULL FLOW BYPASS VALVE

This invention relates generally to the testing of oil wells, and more particularly, but not by way of limitation, is advantageously employable in offshore and underwater wells.

After an oil well has been encased and cemented it usually becomes desirable to test the formation penetrated by the well bore for possible production rates and general potential of the well. In doing so, a testing string containing several different types of tools is utilized to determine the productivity of the well. These tools may include a pressure recorder, a sample chamber, a closed in pressure tester, a hydraulic jar, one or more packers, a circulating valve, and possibly several other tools.

The testing procedure requires the opening of a section of the well bore to atmospheric or reduced pressure. This is accomplished by lowering the testing string into the hole on drill pipe with the tester valve and sample chamber closed to prevent entry of well fluid into the drill pipe. With the testing string in place in the formation, packers are expanded to seal against the well bore or casing to isolate the formation to be tested. Above the formation, the hydrostatic pressure of the well fluid is supported by the upper packer. The well fluid in the isolated formation area is allowed to flow into the drill string by opening the tester valve. Fluid is allowed to continue flowing from the formation to measure the ability of the formation to produce. The formation may then be "closed in" to measure the rate of pressure buildup. After the flow measurement and pressure buildup curves have been obtained, samples can be trapped and the testing string removed from the well.

Earlier methods used to open and close the necessary valve chambers in the testing string involved physical manipulations of the string in vertical reciprocation, rotational motion or a combination of both. Another prior method involved use of heavy bars or balls dropped down the string to actuate certain tools in the string.

All of these prior methods suffer the serious disadvantage of requiring movement of or within the drill pipe. This is especially disadvantageous in offshore drilling because of the danger of drill pipe separation or blowout during the period the blowout preventer rams are removed from the drill pipe during the manipulation of the string or dropping of objects down the pipe.

One means for operating tools in the testing string without manipulation of the pipe, which has proven very successful, involves the use of annulus pressure operated testing tools. Examples of these tools include the annulus pressure responsive (APR) safety sampler disclosed in U.S. Pat. No. 3,664,415, the APR disc valve disclosed in U.S. Pat. No. 3,779,263, the APR circulating valve disclosed in U.S. Pat. No. 3,850,250, the APR circulation and tester valve disclosed in U.S. Pat. No. 3,970,147, the APR full opening tester valve apparatus disclosed in U.S. Pat. No. 3,856,085 and the APR full opening tester valve disclosed in U.S. Pat. No. 3,964,544, all assigned to the assignee of the present application, Halliburton Company, and incorporated herein by reference.

In the employment of testing strings utilizing the various APR tools mentioned above, it has been found to be important to be able to run the testing string into the well bore with the tester valve in the closed position and with a bypass open in the testing string above the packer and under the closed tester valve. When it is desired to set the packer, such manipulation is ordinarily accomplished by rotating the testing string and setting weight down on the packer to expand the packer sealing elements into contact with the casing or the wall of the well bore. The utilization of rotationally operated conventional bypass valves intermediate the packer and the tester valve has been somewhat disadvantageous and unreliable because it is often difficult to tell whether or not the bypass valve is closed at the time the packer is set since both operations require vertical and rotational manipulation of the tubing string to actuate the tools.

It is, therefore, advantageous to employ a bypass valve in the testing string which can be reliably operated to close the bypass through mere application of testing string weight thereto while permitting the application of both rotational force and weight through the open bypass valve structure to the packer to achieve engagement between the packer and the casing or well bore.

The full flow bypass valve assembly of the present invention overcomes the disadvantages of the prior art bypass valve mechanism and is eminently suitable for employment in offshore and underwater environments in conjunction with annulus pressure responsive tester valves, circulation valves and the like.

Figure 1A:
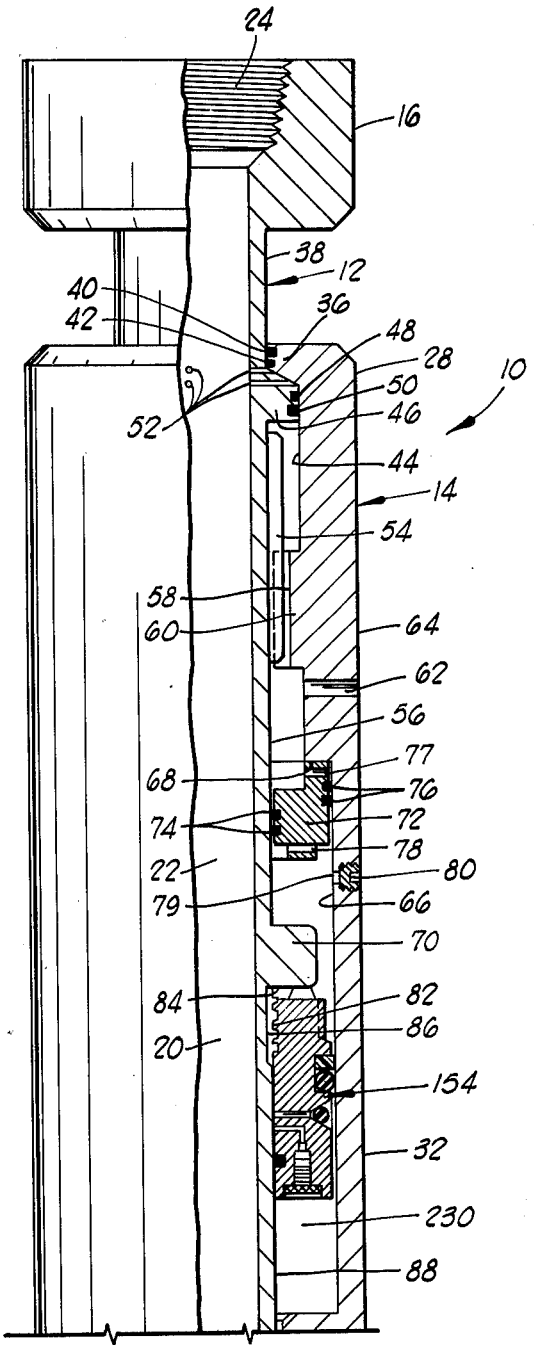
FIGS. 1A and 1B are vertical, partially cross-sectional views of the upper and lower portions, respectively, of a full flow bypass assembly constructed in accordance with the present invention.
Figure 1B:
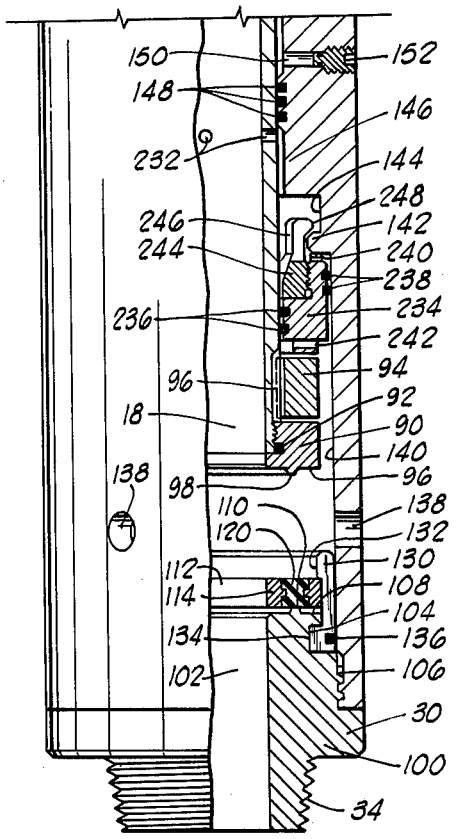

Referring now to the drawings, and to FIGS. 1A and 1B in particular, a full flow bypass assembly constructed in accordance with the present invention is illustrated therein and is generally designated by the reference character 10. The bypass assembly 10 comprises an inner tubular mandrel assembly 12 and an outer tubular housing assembly 14. The assemblies 12 and 14 are each constructed of a plurality of mutually threadedly interconnecting elements in a conventional manner to facilitate assembly of the bypass tool 10.

The inner tubular mandrel assembly 12 includes an upper end portion 16, a lower end portion 18 and an intermediate portion 20. A substantially cylindrical passage 22 communicates between the upper and lower end portions 16 and 18. The upper end portion 16 is internally threaded as shown in 24 to facilitate the threaded connection of the bypass assembly 10 to a tubing or testing string or the like extending upwardly therefrom as will be described more fully hereinafter. The tubular mandrel assembly 12 is longitudinally, slidably disposed within the tubular housing assembly 14.

The tubular housing assembly 14 includes an upper end portion 28, a lower end portion 30 and an intermediate portion 32. The lower end portion 30 is externally threaded as shown at 34 to facilitate threaded connection of the bypass assembly 10 to a portion of a tubing or testing string extending downwardly therefrom as will be more fully described hereinafter. The upper end portion 28 of the housing assembly 14 includes a radially inwardly extending annular shoulder 36 which slidingly engages a corresponding cylindrical outer surface 38 formed on the upper end portion 16 of the mandrel assembly 12. A pair of annular sealing members 40 and 42 are carried in corresponding annular grooves in the annular shoulder 36 and provide a sliding, substantially fluid-tight seal between the annular shoulder 36 and the cylindrical surface 38.

A substantially cylindrical inner surface 44 extends downwardly from the annular shoulder 36. A radially outwardly extending annular shoulder 46 extends outwardly from the cylindrical surface 38 of the mandrel assembly 12 and slidingly engages the cylindrical surface 44 of the housing assembly 14. A pair of annular sealing members 48 and 50 are carried in corresponding annular grooves in the annular shoulder 46 and provide a substantially fluid-tight, sliding seal between the annular shoulder 46 and the cylindrical shoulder 44. Ports 52 communicate between the interior and exterior of the mandrel assembly 12 between the annular sealing member 48 and the cylindrical surface 38 to prevent fluid lock between the mandrel assembly and housing assembly.

A plurality of longitudinally aligned ribs 54 are formed on a cylindrical outer surface 56 formed on the mandrel assembly 12 and extend downwardly from the annular shoulder 46. The ribs 54 are received in corresponding longitudinally aligned grooves 58 formed on an annular shoulder 60 extending radially inwardly from the cylindrical surface 44 of the housing assembly 14 to provide splined interconnection between the mandrel assembly and the housing assembly to prevent relative rotation therebetween while at the same time permitting relative longitudinal displacement between the mandrel assembly and the housing assembly. At least one port 62 communicates between the exterior 64 and the cylindrical inner surface 44 of the housing assembly 14.

A second cylindrical inner surface 66 is formed in the housing assembly 14 and is connected to the cylindrical surface 44 via a radial shoulder 68. A second annular shoulder 70 extends radially outwardly from the cylindrical surface 56 of the mandrel assembly 12. An annular piston 72 is positioned between the outer surface 56 of the mandrel assembly and the inner surface 66 of the housing assembly intermediate the annular shoulder 70 of the mandrel assembly and the radial shoulder 68 of the housing assembly. The piston 72 is adapted for longitudinal sliding movement along the cylindrical surfaces 56 and 58. Annular seal members 74 and 76 are carried in corresponding annular grooves formed in the piston 72 and provide sliding, fluid-tight seals between the piston 72 and the surfaces 56 and 66, respectively. Radial passages 77 and 78 are formed in the piston 72 to prevent fluid lock between the piston and the housing assembly and mandrel assembly, respectively. An internally threaded port 79 communicates between the exterior 64 and the inner surface 66 of the housing assembly and is sealed closed by a removable, externally threaded plug 80. The port 79 is positioned near but spaced downwardly from the radial shoulder 68. The previously mentioned ports 52 communicating between the interior and exterior of the mandrel assembly 12 and the port 62 communicating between the interior and exterior of the housing assembly 14 providing balancing of the downhole hydraulic pressure acting on the annular area between the sealing members 40 and 42 and the sealing members 48 and 50 and the annular area between the sealing members 48 and 50 and the sealing members 74 of the mandrel assembly 12, respectively.

External threads 82 extend a distance downwardly from the lower face 84 of the second annular shoulder 70 of the mandrel assembly 12. A plurality of longitudinally aligned grooves 86 extend downwardly from the floor face 84 interrupting the external threads 82 in circumferentially spaced array to thereby provide a fluid passage through the threads 82 for purposes which will be described in greater detail hereinafter. A third cylindrical outer surface 88 extends downwardly from the external threads 82 to the lower end portion 18 of the mandrel assembly 12. An annular end cap 90 is threadedly secured to the lower end portion of the mandrel assembly 12 and a fluid-tight seal is achieved therebetween by means of an annular seal member 92 carried in a corresponding groove in the end cap 90. A torquing lug 94 is splined to the exterior of the lower end portion 18 of the mandrel assembly 12 as shown at 96 and is retained in position thereon by means of the end cap 90. The non-circular exterior of the torquing lug 94 provides means for securely gripping the mandrel assembly 12 to facilitate the threaded engagement between the end cap 90 and the lower end portion of the mandrel assembly. The lower end face 96 of the end cap 90 is provided with a downwardly projecting annular rib 98.

The lower end portion 30 of the housing assembly comprises an externally threaded adapter or nipple 100 which is threadedly secured to the lower end of the intermediate portion 32 of the housing assembly. The previously mentioned external threads 34 are formed on the lowermost portion of the adapter 100. The adapter 100 is provided with a longitudinal passage 102 having a diameter substantially equal to the diameter of the passage 22 of the mandrel assembly 12. A circumferential annular recess 104 is formed in the upper portion of the adapter 100 intermediate the external threads 106 and the upper end face 108 of the adapter. An upwardly facing annular rib 110 is formed on the upper end face 108 and is of substantially the same diameter as and is in coaxial alignment with the annular rib 98 on the lower end face 96 of the mandrel assembly 12.

Figure 5:
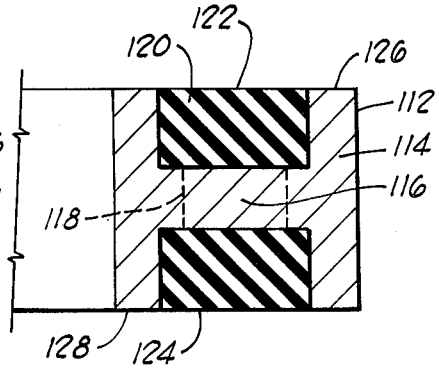
FIG. 5 is a partial enlarged vertical cross-sectional view of a face seal assembly constructed in accordance with the present invention.

A face seal assembly 112 is positioned adjacent to and in coaxial alignment with the annular rib 110 of the adapter or nipple 100. The face seal assembly comprises an annular metallic seal carrier 114 having a substantially H-shaped cross-section, as best shown in FIG. 5. The horizontal medial portion 116 of the seal carrier 114 is penetrated by a plurality of circumferentially spaced vertically aligned apertures 118. The face seal assembly 112 further includes a resilient annular seal element 120 integrally molded to the seal carrier 114 such that the upper and lower end faces 122 and 124 are substantially flush with the upper and lower end faces 126 and 128 of the seal carrier 114, respectively. The seal element 120 may be suitably formed of an elastomeric material or a resilient synthetic resin material.

The face seal assembly 112 is retained in position with the lower end face 124 of the seal element 120 in contact with the upwardly extending annular rib 110 of the adapter or nipple 100 by means of a pair of semicircular seal retainers 130 (one shown) forming a longitudinally split annular seal retainer assembly. The upper end portion of each of the seal retainers 130 of the seal retainer assembly carries a radially inwardly extending shoulder 132 which engages the upper end face 126 of the seal carrier 114. The lower portion of each of the seal retainers 130 of the longitudinally split seal retainer assembly carries another radially inwardly extending shoulder 134 which is received in the annular recess 104 of the adapter or nipple 100. A resilient annular seal member 136, such as an elastomeric O-ring, is carried in corresponding exterior grooves formed in the peripheries of the lower portions of the seal retainers 130 to retain the seal retainers and face seal assembly on the nipple 100 during assembly.

A plurality of bypass ports 138 are formed in the intermediate portion 32 of the housing assembly 14 proximate to the face seal assembly 112. A cylindrical inner surface 140 is formed in the intermediate portion 32 and extends upwardly from the ports 138 to a radially inwardly extending annular shoulder 142. An annular recess 144 is formed on the interior of the intermediate portion 32 and extends upwardly from the annular shoulder 142 to another radially inwardly extending annular shoulder 146 also formed on the interior of the intermediate portion 32. A plurality of annular seal members 148 are carried in corresponding annular grooves the annular shoulder 146 and provide a sliding fluid-tight seal between the shoulder 146 and the cylindrical outer surface 88 of the mandrel assembly 12. An internally threaded port 150 communicates between the interior and exterior of the intermediate portion 32 of the housing assembly 14 and positioned above the annular seal members 148. An externally threaded plug 152 is received within the internally threaded port 150 to provide a removable fluid-tight closure of the port 150.

Figure 2:
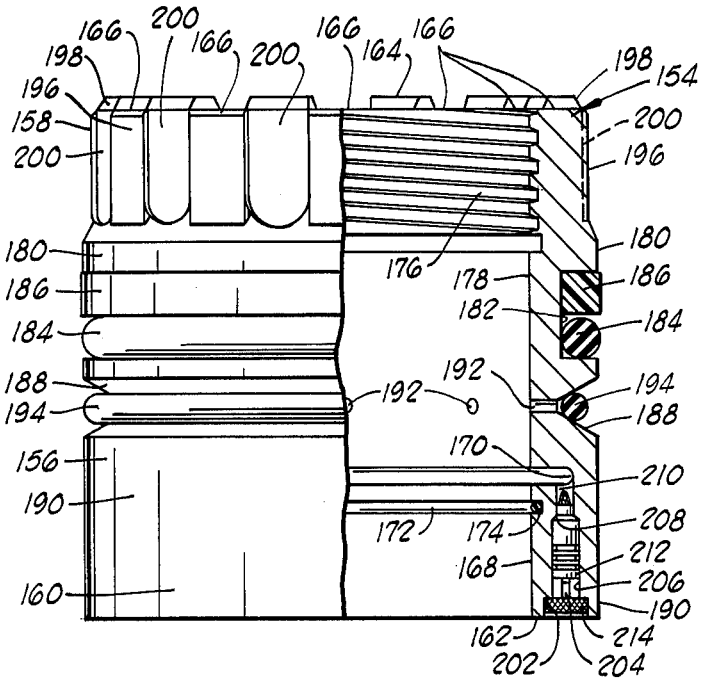
FIG. 2 is an enlarged, vertical, partially cross-sectional view of an annular metering housing constructed in accordance with the present invention.
Figure 3:
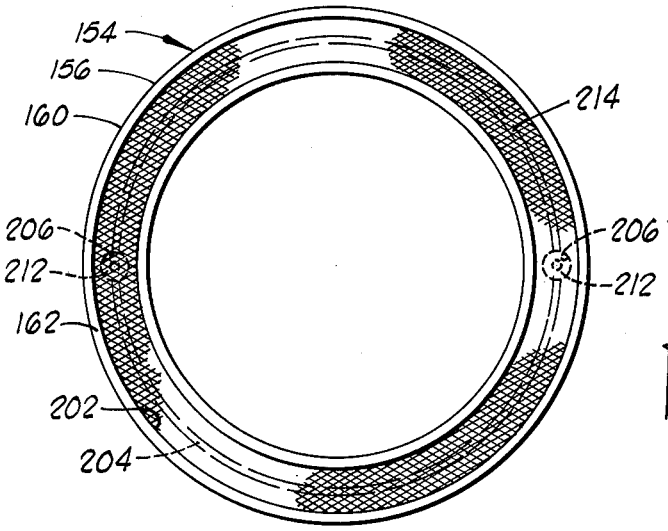
FIG. 3 is a bottom plan view of the annular metering housing depicted in FIG. 2.

An annular metering housing assembly 154 is positioned in the annular space between the second cylindrical inner surface 66 of the housing assembly and the cylindrical outer surface 88 of the mandrel assembly intermediate the annular shoulder 70 of the mandrel assembly and the annular shoulder 146 of the housing assembly. The details of construction of the annular metering housing assembly 154 are best shown in FIGS. 2 and 3.

The metering housing assembly 154 comprises a tubular body member 156 having an upper end portion 158 and a lower end portion 160. The lower radial end face 162 is formed on the lower end portion 160. An upper radial end face 164 is formed on the upper end portion 160 and is interrupted by a plurality of circumferentially spaced radial slots 166.

A substantially cylindrical inner surface 168 extends upwardly from the lower end face 162 and intersects an annular groove 170 formed in the interior of the body member 156. A resilient annular seal member 172, such as an elastomeric O-ring, is positioned within a corresponding annular groove 174 formed in the inner surface 168 intermediate the lower end face 162 and the annular groove 170.

Internal threads 176 extend downwardly from the radial slots 166 in the interior of the upper end portion 158 of the body member 156. A second substantially cylindrical inner surface 178 is formed on the interior of the body member 156 and extends between the internal threads 176 and the annular groove 170. The diameter of the cylindrical surface 178 is preferably greater than the diameter of the cylindrical surface 168. The diameter of the cylindrical surface 168 is sized to provide a close fit around the cylindrical outer surface 88 of the mandrel assembly 12 and the annular seal member 172 provides a fluid-tight seal between the body member 156 and the mandrel assembly 12. The internal threads 176 provide threaded engagement with the external threads 82 of the mandrel assembly 12 to secure the annular metering housing assembly 154 to the mandrel assembly 12 as shown in FIG. 1A with the upper end face 164 abutting the lower face of the second annular shoulder 70 of the mandrel assembly.

A substantially cylindrical outer surface 180 is formed on the exterior of the body member 156 intermediate the upper and lower end portions thereof. A circumferential groove 182 is formed in the outer surface 180 and carries a resilient annular sealing member 184 and a relatively rigid backup ring 186 therein. The annular sealing member 184 is preferably formed of an elastomeric or synthetic resin O-ring, while the backup ring 186 is preferably in the form of a substantially rigid, glass-filled Teflon ring of rectangular cross-section. The diameter of the outer surface 180 is slightly less than the diameter of the second cylindrical inner surface 66 of the housing assembly 14 to provide a close sliding fit therebetween. The annular sealing member 184 provides a sliding fluid-tight seal between the body member 156 and the housing assembly 14 while the relatively rigid backup ring 186 provides extremely close sliding engagement with the cylindrical inner surface 66 to prevent the possible extrusion of the annular sealing member upwardly between the backup ring and the housing assembly during operation of the bypass assembly 10.

The lower portion of the cylindrical outer surface 180 communicates with a V-shaped circumferential groove 188 formed in the exterior of the body member 156. A second substantially cylindrical outer surface 190, having a diameter preferably slightly less than the diameter of the cylindrical surface 180, extends between the lower portion of the circumferential groove 188 and the lower end face 162 of the body member 156. A plurality of radial passages 192 communicate between the inner surface 178 and the circumferential groove 188 of the body member 156 and are preferably circumferentially spaced about the body member 156. A resilient annular sealing member 194, preferably in the form of an elastomeric or synthetic resin O-ring of substantially circular cross-section, is positioned in the annular groove 188. The inherent resilience of the annular sealing member 194 biases the sealing member into snug contact with the innermost portion of the circumferential groove 188 to close the passage 192 at their points of communication with the circumferential groove 188 thereby acting as a one way check valve member.

At the upper end portion 158 of the tubular body member 156, a substantially cylindrical outer surface 196 of reduced diameter extends upwardly from the outer surface 180 to a beveled annular surface 198 which communicates with the upper end face 164. A plurality of circumferentially spaced longitudinal grooves 200 are preferably formed in the outer surface 196 to facilitate engagement of the body member 156 to achieve threaded engagement between the metering housing assembly 154 and the mandrel assembly 12.

An annular groove 202 is formed in the lower end face 162 of the body member 156. A narrower annular groove 204 is formed in the body member 156 centrally of the annular groove 202. One or more longitudinal bores 206 are formed in the lower end portion of the body member 156, with each bore 206 positioned centrally of the annular grooves 202 and 204. Each bore 206 communicates with a coaxial annular shoulder 208 and a coaxial bore 210 which communicates with the annular groove 170 and has a diameter less than the diameter of the corresponding bore 206.

A fluid flow restriction jet assembly 212 is securely sealingly positioned within a corresponding bore 206 in abutment with the coaxial annular shoulder 208. The jet assembly 212 is preferably a commercially available hydraulic insert disclosed in U.S. Pat. No. 3,323,550 and assigned to The Lee Company, 2 Pettipaug Rd., Westbrook, Conn., and sold under the designation "LEE VISCO JET", which patent, and the subject matter thereof, is incorporated herein by reference. Various configurations of "LEE VISCO JET" flow restriction devices can be specified and installed in the annular metering housing assembly 154 to provide a predetermined amount of fluid resistance for the metering assembly 154.

The liquid flow restriction jet assembly 212 includes a housing having a longitudinal fluid passage therethrough, across which at least one cylindrical, disc-like, three-piece body structure is positioned, which body structure includes an orifice plate, a front cover plate and a rear cover plate secured together in sandwich fashion. The front surface of the orifice plate is ground and lapped for fluid-tight engagement with the ground and lapped rear face of the front cover plate to thereby establish fluid-tight engagement therebetween. Similarly, the rear face of the orifice plate is ground and lapped to establish a fluid-tight engagement with the similarly finished front face of the rear cover plate. Each of the cover plates contains a centrally located single aperture which functions as either a fluid entrance or exit hole as the direction of fluid flow through the housing fluid passage may dictate. Typically, a central aperture is provided in the front cover plate to form the fluid entrance and a central aperture is provided in the rear cover plate to form a fluid exit.

The front surface of the orifice plate includes a generally cylindrical, centrally located chamber formed therein which acts as a fluid entrance chamber and communicates with the central structure in the front cover plate. The fluid entrance chamber has an imperforate lower face and communicates with the next or second cylindrical chamber in the fluid path through a passageway whose outer side wall is tangent to the cylindrical side walls of the two chambers. Centrally arranged in the next or second cylindrical chamber in the fluid path is an orifice of a diameter smaller than the diameter of the second cylindrical chamber and extending axially through the orifice plate to communicate with a third cylindrical chamber which is disposed on or formed in the rear face of the orifice plate. The third cylindrical chamber is of the same outside diameter as the previously mentioned second cylindrical chamber and communicates with the next or fourth cylindrical chamber in the rear face of the orifice plate by a passageway which is arranged tangentially with the third and fourth chambers. Centrally arranged in the fourth cylindrical chamber in the fluid path is another orifice of a diameter smaller than the diameter of the fourth cylindrical chamber and extending axially through the orifice plate to communicate with a fifth cylindrical chamber disposed on or formed in the front surface of the orifice plate. The previously described tortuous fluid passage or path continues through the three-piece body structure until the fluid passage terminates at an exit chamber which is disposed or formed in the rear face of the orifice plate opposite to the entrance chamber in the front face of the orifice plate and which communicates with the central aperture in the rear cover plate.

It will be seen that the fluid passing through the longitudinal passage in the housing of the fluid flow restriction jet assembly 212 enters the central fluid entrance aperture in the front cover plate and proceeds to the entrance chamber in the orifice plate. The fluid thereafter progresses through a passageway to a cylindrical chamber, proceeds through an orifice to another cylindrical chamber on the opposite side of the orifice plate, from there to a third passageway and on to the next cylindrical chamber, back through an orifice and so forth to proceed through a tortuous path comprised of a series of serially arranged orifices with chambers disposed on each side of each orifice to reach the exit chamber and central aperture in the rear cover plate. Adjacent cylindrical chambers in the fluid path on the same side of the orifice plate are connected by respective tangential passageways. A typical orifice plate may be provided with forty chambers which serve to connect the entrance and exit holes of the front and rear cover plates with nineteen serially connected orifices.

Figure 4:
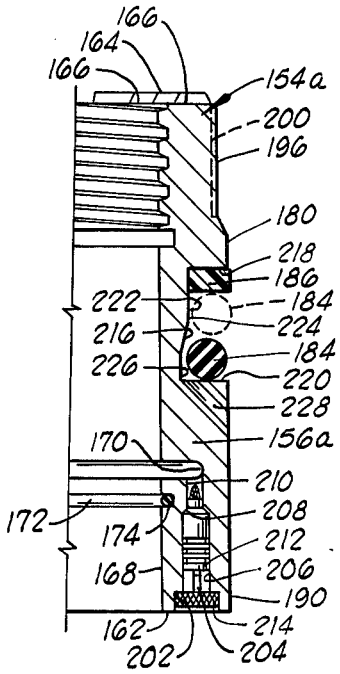
FIG. 4 is a partial enlarged vertical cross-sectional view of an alternate form of annular metering housing constructed in accordance with the present invention.

As clearly pointed out in U.S. Pat. No. 3,323,550, the fluid flow path through the portion of the orifice plate, as is illustrated in FIG. 4 thereof, is generally rotary within the cylindrical chambers thereby giving rise to the term "spin chamber." The fluid spins in each chamber so as to make many revolutions thereby using the flow passage surfaces in each chamber many times although the exact nature of the fluid spin has not been determined. Such a spinning action tends to reduce clogging of the orifices by foreign particles of comparatively large size. Moreover, provision of such a chamber to induce fluid spin permits use of a larger orifice for a given pressure drop to thereby further minimize any clogging.

Each passage or slot which interconnects the adjacent pairs of spin chambers is arranged tangential to each spin chamber and it is believed that the tangential nature of each of the connecting slots not only serves to assist in imparting spin to the fluid but also serves to overcome the expected sensitivity of such orifice arrangement to the viscosity of the fluid passing therethrough. As the fluid enters a spin chamber, it spins around the central bore or orifice and exits through the orifice, still spinning, to reach the spin chamber on the opposite side of the orifice plate. The direction of spin in the spin chamber on the opposite side of the orifice plate is opposite to the direction of fluid flow through the passageway to the next spin chamber adjacent thereto thereby causing the first-mentioned spin chamber to act as a deceleration chamber. Because the fluid spin direction in each deceleration chamber is in opposition to the direction by which the fluid must exit from the deceleration chamber, the fluid must actually come to rest before it makes its exit from the deceleration chamber. The spin chambers positioned directly opposite one another on the orifice plate can be considered an axial pair of spin chambers attached to opposite ends of the interconnecting orifice, and the fluid flow path heretofore described is repeated over and over for each axial pair chambers throughout the path of fluid as it criss-crosses back and forth across the surface of the orifice plate as well as axially through the orifices from one side of the orifice plate to the other.

It is believed that the viscosity compensation is obtained in the liquid flow restriction jet assembly by two effects which are independent, but both of which can make the fluid flow increase as the viscosity increases. The first effect is that of the back pressure of the spin slots interconnecting adjacent spin chambers. This back pressure varies as the square of the fluid spin velocity and when the velocity increases, the spin velocity tends to decrease, thereby decreasing the back pressure so as to permit a higher flow of fluid from a deceleration spin chamber through the spin slot into the next spin chamber. The second effect which cooperates in the viscosity compensation occurs in the deceleration spin chamber. If the liquid is spinning at a high speed when it enters a deceleration spin chamber, energy is absorbed to bring this liquid to rest and subsequently accelerate it out in the opposite direction. This energy change shows up as a pressure drop such that if the viscosity increases the liquid is not spinning as fast when it enters the deceleration chamber and it will therefore be discharged with a smaller pressure drop.

It will be seen that the utilization of a fluid flow restriction jet assembly 212 of the type disclosed and claimed in U.S. Pat. No. 3,323,550 in the construction of the annular metering housing assembly 154 of the present invention provides a number of advantages in the present invention. Significant reduction in the possibility of clogging in the orifices in the fluid flow restriction jet assembly 212 is an extremely valuable characteristic when employed in the hostile environment of a well bore where a failure of the tool in which the device is installed could cause extremely expensive delays in well testing or the like. The viscosity compensation characteristics of the fluid flow restriction jet assembly 212 provides the advantage of substantially constant operating characteristics of the tool in which it is installed irrespective of the temperature encountered in the depths of the well bore which might otherwise adversely affect the response time of the tool in which the fluid flow restriction jet assembly is installed.

A five micron annular wire screen 214 is secured within the annular groove 202 to filter liquid passing upwardly therethrough and through the flow restriction jet assembly 212.

FIG. 4 illustrates a slightly modified version of the annular metering housing assembly of the present invention which is designated by the reference characteer 154*a*. Those elements of the housing assembly 154*a* which are unchanged from the housing assembly 154 carry identical reference character designations. The metering housing assembly 154*a* is characterized by a modified circumferential groove 216 formed in the cylindrical outer surface 180 of the modified body member 156*a*. The groove 216 includes a radial upper surface 218 and a radial lower surface 220. An upper cylindrical circumferential surface 222 extends downwardly from the upper surface 218 and communicates with a frusto-conically shaped circumferential surface 224 which, in turn, communicates with a second cylindrical circumferential surface 226 which communicates with the radial lower surface 220. The relative diameters of the circumferential surfaces 222 and 226 are such that when the annular sealing member 184 is positioned in contact with the backup ring 186 and the circumferential surface 222, as shown in dashed lines, a sliding fluid-tight seal is achieved between the tubular body member 156*a* and the housing assembly 14, while on the other hand when the annular sealing member 184 is moved downwardly within the circumferential groove 216 into contact with the radial lower surface 220, as shown in solid lines, the sliding fluid-tight seal between the tubular body member 156*a* and the housing assembly 14 is terminated.

A plurality of circumferentially spaced passages 228 communicate between the circumferential groove 216, at the intersection between the radial lower surface 220 and the second circumferential surface 226, and the cylindrical outer surface 190.

The above-described structure of the annular metering housing assembly 154*a* provides another form of check valve mechanism in substitution for the V-shaped circumferential groove 188, annular sealing member 194 and plurality of radial passages 192 in the previously described annular metering housing assembly 154. The remaining structure of the annular metering housing assembly 154*a* is substantially identical to the metering housing assembly and need not be described in detail again.

Referring again to FIGS. 1A and 1B, a quantity of liquid 230, such as oil, is contained in the annular space between the mandrel assembly 12 and housing assembly 14 and intermediate the annular pistion 72 and the annular seal members 148. The liquid 230 may be conveniently deposited within this annular space by placing the completely mechanically assembled bypass assembly 10 in a horizontal position with the ports 79 and 150 extending upwardly. The plugs 80 and 152 are then removed and the liquid is introduced through port 79 until liquid is ejected from the port 150 and is completely devoid of any air bubbles therein. The plugs 80 and 152 are then rethreaded into the corresponding ports to seal the liquid 230 within the annular space.

A plurality of radial ports 232 extend through the wall of the mandrel assembly 12 at a position just below the annular seal members 148 when the mandrel assembly 12 is in its uppermost position relative to the housing assembly 14. An annular piston 234 is positioned between the outer surface 88 of the mandrel assembly and the inner surface 140 of the housing assembly. The piston 234 is adapted for longitudinal sliding movement along the cylindrical surfaces 88 and 140. Annular seal members 236 and 238 are carried in corresponding annular grooves formed in the piston 234 and provide sliding, fluid-tight seals between the piston 234 and the surfaces 88 and 140, respectively. Radial ports 240 and 242 are formed in the piston 234 to prevent fluid lock between the piston and the housing assembly and torquing lug 94, respectively.

A piston retainer ring 244 is threadedly secured to the upper portion of the piston 234. The piston retainer ring 244 includes a plurality of upwardly projecting spring fingers 246 each having a radially outwardly extending shoulder 248 formed thereon, for releasably engaging the annular 142 of the housing assembly 14, as shown in FIG. 1B.

Figure 6:
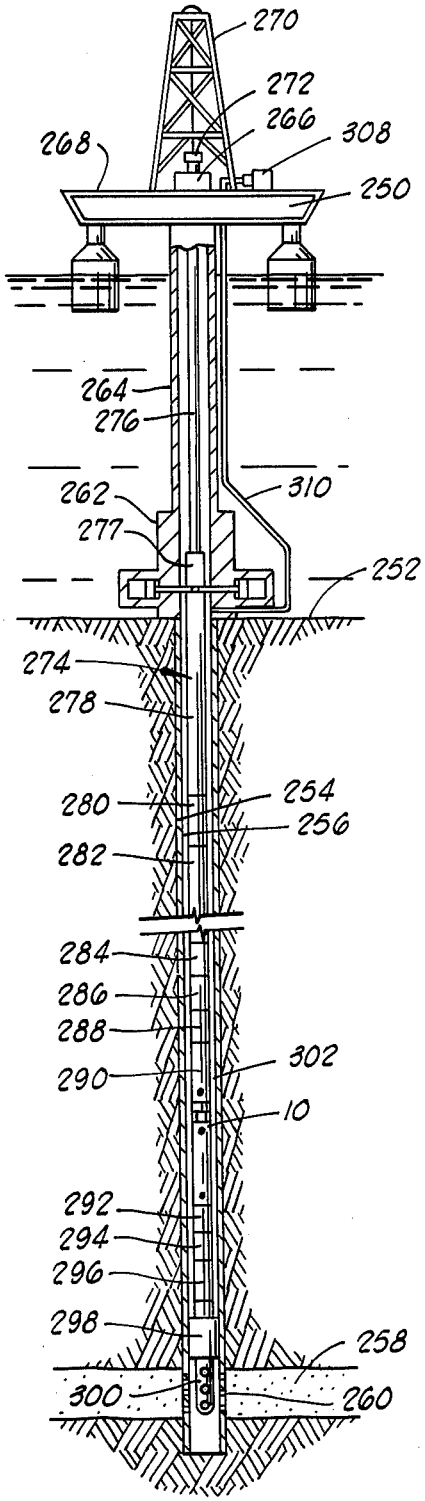
FIG. 6 is a schematic, vertical, elevational view of an offshore test site illustrating a testing string disposed within a submerged well and intersecting a submerged formation.

In operation, the full flow bypass assembly 10 may be advantageously employed in a tubular formation testing string as an integral part thereof. FIG. 6 illustrates schematically such a testing string being employed in an offshore environment with the bypass assembly 10 installed therein.

In FIG. 6, a floating drilling vessel 250 is positioned over a submerged well site 252. A well bore 154 having a casing lining 256 therein extends downwardly from the ocean floor and penetrates a formation 258 which is to be tested. The casing 256 penetrating the formation 258 is suitably perforated as shown at 260 to permit the entrance of production fluids into the cased well bore.

A submerged well head 262 having conventional blowout preventer means installed therein is sealingly connected to the upper end of the casing 256. A marine conductor 264 sealingly communicates with the wellhead 262 and extends upwardly therefrom to the ocean surface terminating in a suitable wellhead structure 266 at the deck 268 of the drilling vessel 250. A conventional derrick structure 270 provides support at the drilling vessel 250 for suitable hoisting means 272 for the formation testing string 274 which extends downwardly from the hoisting means to the wellhead 266, marine conductor 264, wellhead 262, and casing string 256 to a position proximate to the formation 258 to be tested.

The formation testing string 274 is of relatively conventional construction and comprises from top to bottom an upper conduit string portion 276, a hydraulically operated conduit string test tree 277, an intermediate conduit portion 278, a torque transmitting, pressure and volume balanced slip joint 280, a second intermediate conduit portion 282 for imparting packer setting weight to a lower portion of the testing string, a conventional circulating valve 284, a third intermediate conduit portion 286, an upper pressure recorder and housing 288, suitable valving and sample entrapping apparatus 290, the full flow bypass assembly 10, a lower pressure recorder and housing 292, a suitable hydraulic jar 294, a conventional safety joint 296, a hook wall packer mechanism 298, and a suitable perforated tail pipe 300.

The test tree mechanism 277 incorporated in the testing string 274 preferably comprises a hydraulically operable valve assembly commercially available from Otis Engineering Corporation, Dallas, Tex. The apparatus 277 is designated by this manufacturer as a Removable Subsea Test Tree, the structure and formation of which is described in greater detail in Manes et al. U.S. Pat. No. 3,646,995 which is incorporated herein by reference.

The slip joint mechanism 280 suitably comprises a pressure and volume balanced slip joint of the type described in Hyde U.S. Pat. No. 3,354,950 which is incorporated herein by reference. The Hyde slip joint comprises an extensible and contractile telescoping coupling in the testing string 274, which coupling is pressure and volume balanced, telescoping in nature, and operable to effectively minimize or eliminate the transmission of wave action-induced force acting on the upper conduit string portion 276 and the floating vessel 250 through the testing string to the packer 298 and the valving and sample trapping mechanism 290.

With this basic disposition of components in the testing string 274, the valving mechanism included in the apparatus 290 can be operated so as to close the longitudinally extending interior passage of the testing string 274, open this passage, or close the passage so as to entrap a sample of formation fluid within the body or conduit means portion of the apparatus 290.

As the valving elements of the apparatus 290 are manipulated, the pressure recorders 288 and 292, disposed respectively above and below the apparatus 290, will continuously record the pressure of formation fluid at these locations in the testing string in a well recognized fashion.

During the testing operation, or during the removal or installation of the testing string, it may be desirable to effect a circulation of fluid between the interior of the testing string and the annular space 302 between the testing string 274 and the casing 256. Such circulation of fluid is permitted by the circulating valve 284, which valve is normally disposed in a closed condition. The valve 284 may comprise a ratchet-type annulus pressure operated sleeve valve such as that disclosed in Holden et al. U.S. Pat. No. 3,850,250 and incorporated herein by reference. .

As is often done, from a safety standpoint, the testing string 274 is provided with the hydraulic jar mechanism 294 in anticipation of the possibility that release of the packer 298 may be impeded for a variety of operational reasons. An effective jarring mechanism which can be utilized for this purpose, comprises a hydraulic jar mechanism of the type generally featured in Barrington U.S. Pat. No. 3,429,389, or the type featured in Barrington U.S. Pat. No. 3,399,740, both of which are incorporated herein by reference.

As a further safety feature, the testing string 274 is provided with the safety joint 296 between the jarring mechanism 294 and the packer 298. A safety joint eminently suitable for employment in this manner is featured in Barrington U.S. Pat. No. 3,368,829 which is incorporated herein by reference. This safety joint permits the testing string 274 to be disconnected from the packer 298 and removed from the well bore should the packer 298 become stuck.

Figure 7:
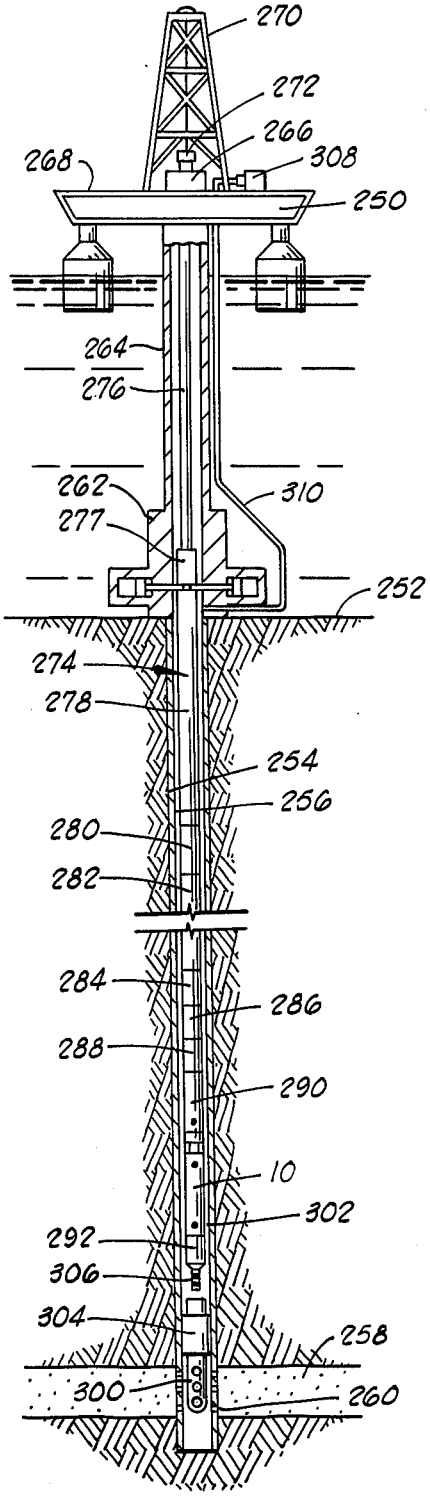
FIG. 7 is a schematic, vertical, elevational view of an offshore test site illustrating another form of test string disposed within a submerged well prior to engagement of a probe or stinger carried thereon with a previously set packer.

Under certain conditions, the packer 298 may not be attached to the testing string 274. For example, as shown in FIG. 7, a drillable testing packer 304 can be set by a wire line previous to the lowering of the remainder of the testing string 274 and the coupling thereof with the packer 304 by means of a probe or stinger 306 carried by the test string 374 in substitution for the previously described hydraulic jar 294 and safety joint 296. Such an arrangement is generally described in Evans et al. U.S. Pat. No. 3,432,052 which is incorporated herein by reference.

The valving and sample trapping mechanism 290 comprises an annulus pressure responsive ball valve mechanism which is adapted to open at a predetermined pressure of the fluid in the annular space 302 adjacent the mechanism 290. A suitable valve for this application is the subject of Farley et al. U.S. Pat. No. 3,964,544 which is incorporated herein by reference. This valve is adapted to open from an initially closed position upon the raising of the well fluids in the annular space 302 to a predetermined pressure greater than the pressure acting on the interior of the valve structure at the same location. It has been found advantageous for this opening differential pressure to be approximately 200 psi greater than the interior pressure of the valve structure below the closed ball valve member, with the interior pressure being substantially equal to the hydrostatic pressure at that depth in the well bore.

As is well known conventional procedure in testing wells with a formation testing string such as that disclosed in FIG. 6, the string 274 is run in the casing 256 of the well bore 254 with the valve apparatus of the valving and sample trapping mechanism 290 in the closed position. The full flow bypass assembly 10 is in the open position as illustrated in FIGS. 1A and 1B. When the tail pipe 300 at the lower end of the testing string 274 reaches the desired position proximate to the formation 258 upon which the testing is to be conducted, the packer 298 is then set to seal the zone under test below the packer from the annular space 302 thereabove. Typically, such packers are set by applying right hand rotation to the tubing string while slacking weight off the packer to release the J-slot locking mechanism of the packer and then stopping the rotation and setting approximately 20,000 to 30,000 pounds of string weight on the packer to expand the packer and achieve isolation of the zone under test. Upon the application of this string weight to the packer to achieve the setting thereof, it will be readily apparent that the column of well fluid within the tubing string below the closed valve in the valving and sample trapping mechanism 290 would be compressed to a substantial degree raising the pressure within the tubing string above the hydrostatic pressure, were it not for the open full flow bypass assembly 10 disposed between the packer and the closed valve of the mechanism 290. The novel structure of the full flow bypass assembly 10 permits the application of the necessary string weight to the packer to achieve desired zone isolation for a period of approximately two minutes before the bypass assembly 10 closes communication between the interior and the exterior of the tubing string of the packer through the ports 138 by achieving a fluid-tight seal between the seal element 120 of the face seal assembly 112 and the annular ribs 98 and 110. At the time of this sealing engagement between the ribs and the face seal assembly, the end faces 96 and 108 of the mandrel assembly 12 and housing assembly 14 abut the end faces 126 and 128 of the seal carrier 114, the packer is set and there is substantially no further downward movement of the testing string 274 relative to the packer 298 thereby assuring that the pressure within the tubing string below the closed ball valve apparatus in the valving and sample trapping mechanism 290 is substantially equal to the hydrostatic pressure at that point in the well bore.

It will be understood that the approximately two minute time delay in the telescoping contraction of the full flow bypass assembly 10 is achieved by means of the restricted passage of the liquid 230 from below the annular metering housing assembly 154 upwardly through the liquid flow restriction jet assemblies 212 to the annular space above the metering housing assembly 154. The liquid passes through the filter screen 214 to the liquid flow restriction jet assemblies 212, and from the liquid flow restriction jet assemblies through bore 210 and annular groove 170, and further through the annular space between the cylindrical surface 178 of the body member 156 and the cylindrical surface 88 of the mandrel assembly 12, and thence upwardly through the grooves 86 of the mandrel assembly 12 and the radial slots 166 of the body member 156 to the upper portion of the annular space above the metering housing assembly 154.

It should further be noted that the employment of the full flow bypass assembly 10 in the formation testing string 274 provides an additional significant advantage. It will be understood that the outer diameter of the packer mechanism 298 in the relaxed position is only slightly less than the inner diameter of the casing 256 to which the packer is to be ultimately secured. When running in a formation testing string with the tester valve in the closed position, it is not uncommon for the packer mechanism to incur damage to the sealing elements thereof, dulling of the hydraulic slips and fluid cutting of parts of the packer having close clearance as the well fluids are forced by piston action through the limited clearance between the packer sealing element and the inside diameter of the casing. The utilization of the full flow bypass assembly 10 of the present invention permits the well fluids to flow upwardly through the interior of the lower end portion of the formation testing string 274 below the closed tester valve and bypass 10 to the annulus between the tubing string and the casing above the packer mechanism via the open ports 138 to prevent damage to and possible destruction of the sealing elements of the packer mechanism.

During the running in of the formation testing string 274 as mentioned above, it will be noted that after each stand of tubing is secured to the next lower portion of the testing string as the string is being made up, it is customary for the operator to lower the tubing string downwardly through the casing at a relatively high rate of speed. Since the packer mechanism 298 customarily carries drag blocks or drag springs on the lower portion thereof to provide resistance force against the tubing string at the time of setting of the packer, the weight of the testing string above the packer will be applied through the full flow bypass assembly 10 in order to force the packer mechanism 298 downwardly through the casing. The novel annular metering housing assembly 154 of the full flow bypass assembly 10 permits the formation testing string 274 to be lowered at a relatively high rate through the casing 256 for a period of approximately 2 minutes while maintaining the bypass valve ports 138 in an open position. When the next stand of tubing is secured to the previously run in portion of the testing string 274, the full flow bypass assembly 10 is fully extended through the action of gravity on the elements of the testing string extending therebelow virtually instantaneously through the one-way check valve action of the annular metering housing assembly 154 which permits substantially unrestricted flow of the liquid in the annular space above the tubular body member 156 to the annular space below the tubular body member through the radial slots 166, grooves 86 and annular space between the cylindrical surface 178 of the body member 156 and the cylindrical surface 88 of the mandrel assembly 12, and through the radial passages 192 and past the resilient annular sealing member 194, which is displaced radially outwardly and acts as a one-way check valve element, and through the V-shaped circumferential groove 188 and annular space between the cylindrical outer surface 190 of the body member 156 and the cylindrical inner surface 66 of the housing assembly 14.

If the full flow bypass assembly 10 is employing the slightly modified annular metering housing assembly **154*a*, this last-mentioned liquid flow from the upper portion of the annular space to the lower portion of the annular space is directed between the tubular body member 256 and the cylindrical inner surface 166 of the housing assembly 14 by moving the annular sealing member 184 downwardly within the circumferential groove 216 to a non-sealing position adjacent the radial lower surface 220 thus permitting the liquid to flow by the sealing member 184 and through the passages 228**.

Referring now to FIG. 7, it will be noted that the employment of the full flow bypass assembly of the present invention is equally advantageous in tubing test strings which are employed with previously set packers such as that shown at 304. The valving and sample entrapping mechanism 290 illustrated in FIG. 7 suitably employs the annulus pressure responsive ball valve mechanism described above. When the formation testing string illustrated in FIG. 7 is run in the well bore, the bypass assembly 10 is again in the open position as is illustrated in FIGS. 1A and 1B. Upon initial engagement of the stinger 306 with the previously set packer 304, the sealing members which achieve a fluid-tight seal between the stinger 306 and the packer 304 preliminarily provide a temporary seal or fluid lock between the stinger and the packer. However, before a complete seal can be achieved between these elements sufficient to perform the desired testing on the zone 258, the stinger must be moved substantially further downwardly relative to the packer to complete the sealing engagement therebetween. The use of the full flow bypass assembly 10 in this formation testing string configuration permits the downward movement of the formation testing string, with the tester valve closed, relative to the previously set packer without causing an increase in the fluid pressure within the tubing string below the closed tester valve which, as noted above, would adversely affect the operation of the annulus pressure responsive apparatus of the valving and sample entrapping mechanism 290. At such time as the stinger 306 is fully seated in the packer 304 and after the time delay provided by the bypass assembly 10, the bypass valve ports 138 are closed and the pressure within the tubing string below the closed tester valve will be substantially equal to the hydrostatic pressure at the same depth.

When the full flow bypass assembly 10 is closed in the formation testing string 274, in either the configuration of FIG. 6 or the configuration of FIG. 7, the annulus pressure responsive valve apparatus of the valving and sample trapping mechanism 290 can be actuated by applying additional pressure to the fluid column in the annular space 302 via a suitable pump 308 and supply conduit 310 connected between the pump 308 and the annular space 302 beneath the blowout preventers of the wellhead 262.

It should be noted at this point that the amount of pressure which can be applied to the annular space 302 is normally set by casing or liner limitations at approximately 2500 psi and the annulus pressure responsive valve apparatus of the valving and sample trapping mechanism 290 and the annulus pressure responsive circulation valve 284 must be designed to operate within this range. It is considered essential that the annulus pressure necessary to operate the annulus pressure responsive tester valve of the mechanism 290 and the annulus pressure necessary to operate the circulating valve 284 should have a minimum differential pressure of 600 psi in order to operate the valve member of the mechanism 290 without opening the circulating valve 284. It will be seen that if, in the absence of the full flow bypass assembly 10, the fluid below the closed valve member mechanism 290 were to become pressurized above hydrostatic pressure, the operating pressures of the two annulus pressure responsive tools 290 and 294 could exceed the casing pressure limitations. For example, normal operating pressure of the annulus pressure responsive tester valve of the valving and sample trapping mechanism 290 at 5000 psi hydrostatic pressure at a bottom hole temperature of 270° F. would be approximately 1300 psi. In the absence of the full flow bypass assembly 10, the pressurized fluid inside the formation testing string 274 upon setting of the packer or sealingly engaging the stinger of the previously set packer could be as much as 800 psi above hydrostatic. The operating pressure of the annulus pressure responsive tester valve of the mechanism 290, instead of being 1300 psi, would therefore become 1300 psi, plus 800 psi, plus 200 psi for a total of 2300 psi operating pressure. Therefore, the operating pressure of the annulus pressure responsive circulating valve 284 would have to set at 2300 psi, plus 600 psi differential for a total operating pressure of 2900 psi which exceeds the casing pressure limitation of 2500 psi.

An additional advantage provided by the full flow bypass assembly 10 is that no application of torque applied through the test string is required to open or close the bypass ports 138 as is required in conventional prior art bypass valves. A steady pull on the testing string opens the ports 138 to equalize pressure around the packer, while slacking off on the testing string automatically closes the ports 138 with a predetermined time delay as previously described.

Another significant advantage provided by the full flow bypass assembly 10 is that, once the necessary weight is applied to the tool 10 and the bypass ports 138 are sealed, the bypass ports 138 cannot be pumped open from the application of external or internal pressures. When the bypass assembly 10 is run in with the testing string 274, the piston 234 is releasably secured to the shoulder 142 of the housing assembly by means of the spring fingers 246 as shown in FIG. 1B. If, during the operation of the testing string while the bypass assembly 10 is sealed, the internal pressure in the testing string is raised a predetermined amount over the annulus pressure acting through the ports 138 on the lower surface of the piston 234, the higher internal pressure acting through the ports 232 in the mandrel assembly 12 will overcome the restraining force of the spring fingers to release the piston 234 and force it downwardly into abutment with the torquing lug 94 whereby the pressure differential between the internal pressure in the testing string and the annulus pressure biases the mandrel assembly 12 downwardly relative to the housing assembly 14 thereby overcoming the hydraulics which might otherwise tend to pump open the bypass assembly. A steady pull on the testing string will cause substantially unrestricted upward movement of the mandrel assembly 12 relative to the housing assembly 14 and will recock the piston 234 with the finger 246 engaging the annular shoulder 142 as shown in FIG. 1B.

On the other hand, when the annulus pressure acting through the ports 238 of the sealed bypass assembly 10 exceeds the internal pressure in the testing string, the annulus pressure acts on a differential area on the upper side of the annular end cap which biases the mandrel assembly 12 downwardly into sealing engagement with the face seal assembly 112.

It should further be noted that the novel structure of the full flow bypass assembly 10 facilitates ready interchangeability of the annular metering housing assembly 154 or modified assembly **154*a* to provide various amounts of time delay in the relative contraction of the mandrel and housing assemblies 12 and 14. Further, it will also be noted that the novel annular metering housing assembly 154 or modified assembly 154*a* of the full flow bypass assembly 10** can be equally advantageously applied to other tools where precise regulation of the amount of time required to either contract or expand coaxially telescopic members is desirable. Typical of such applications are in the construction of reciprocably operated tester valves, packer bypass valves and hydraulic jar mechanisms.

Changes may be made in the combination and arrangement of parts or elements as heretofore set forth in the specification and shown in the drawings without departing from the spirit and scope of the invention as defined in the following claims.

What is claimed is:

1. A tool comprising:

an outer tubular member having an inner surface thereon;

an inner mandrel member coaxially disposed within said outer tubular member and having an outer surface thereon;

said inner mandrel member being coaxially movable relating to said outer tubular member;

first and second seal means disposed between said outer tubular member and said inner mandrel member in longitudinal spaced relation for providing respective fluid seals between the surfaces of said outer tubular member and said inner mandrel member thereby defining an annular cavity between said outer and inner members having a substantially constant volume during relative coaxial movement between said inner member and said outer member;

a quantity of fluid disposed within the annular cavity;

annular fluid metering means positioned within said annular cavity, having first and second end portions and inner and outer circumferential surfaces for moving with a first one of said members relative to the other one of said members and to said annular cavity;

means for securing said annular fluid metering means to the first one of said members to facilitate the movement of said fluid metering means with the first one of said members;

first fluid metering seal means for providing a sliding seal between said annular fluid metering means and the surface of the other one of said members;

second fluid metering seal means for providing a seal between said annular fluid metering means and the surface of the first one of said members;

first fluid flow passage means in said annular fluid metering means for providing fluid communication between the first and second end portions of said annular fluid metering means;

fluid flow restriction means interposed in said first fluid flow passage means for alternately accelerating and decelerating a fluid stream passing through said fluid flow restriction means and said first fluid flow passage means from the first end portion toward the second end portion of said annular fluid metering means, whereby a high resistance to fluid flow through said first fluid flow passage means is obtained;

second fluid flow passage means in said annular fluid metering means for providing fluid communication between said first and second end portions of said annular fluid metering means; and check valve means interposed in said second fluid flow passage means for blocking fluid flow through said second fluid flow passage means from the first end portion toward the second end portion of said annular fluid metering means, and, alternately, for allowing substantially unrestricted fluid flow through said second fluid flow passage means from the second end portion toward the first end portion of said annular fluid metering means.

2. A tool comprising:

an outer tubular member having a substantially cylindrical inner surface thereon;

an inner mandrel member coaxially disposed within said outer tubular member and having a substantially cylindrical outer surface thereon;

said inner mandrel member being coaxially movable relative to said outer tubular member;

first and second seal means disposed between said outer tubular member and said inner mandrel member in longitudinal spaced relation for providing respective fixed seals with the substantially cylindrical surface of a first one of said members and for providing respective sliding seals with the substantially cylindrical surface of the other one of said members;

the substantially cylindrical surfaces of said outer tubular member and said inner mandrel member and said first and second seal means defining an annular cavity having a substantially constant volume during coaxial movement of said inner mandrel member relative to said outer tubular member;

a quantity of liquid disposed within said annular cavity;

annular liquid metering housing means positioned within said annular cavity, having first and second end portions and inner and outer circumferential surfaces for moving with the other one of said members relative to the first one of said members;

means for securing said annular liquid metering housing means to the other one of said members to facilitate the movement of said liquid metering housing means with the other one of said members;

first liquid metering seal means for providing a sliding seal between said liquid metering housing means and the substantially cylindrical surface of the first one of said members;

second liquid metering seal means for providing a seal between said liquid metering housing means and the substantially cylindrical surface of the other one of said members;

first flow passage means in said liquid metering housing means for providing liquid communication between the first and second end portions of said liquid metering housing means;

flow restriction means interposed in said first flow passage means for alternately causing acceleration and deceleration of a liquid stream passing through said flow restriction means and said first flow passage means from the first end portion toward the second end portion of said liquid metering housing means, whereby a high resistance to liquid flow through said first flow passage means is obtained;

second flow passage means in said liquid metering housing means for providing liquid communication between said first and second end portions of said liquid metering housing means; and check valve means interposed in said second flow passage means for blocking liquid flow through said second flow passage means from the first end portion toward the second end portion of said liquid metering housing means, and, alternately, for allowing substantially unrestricted liquid flow through said second flow passage means from the second end portion toward the first end portion of said liquid metering housing means.

3. A tool comprising:

an outer tubular member having a substantially cylindrical inner surface thereon;

an inner mandrel member concentrically telescoped within said outer tubular member and having a substantially cylindrical outer surface thereon;

said inner mandrel member being longitudinally, coaxially movable relative to said outer tubular member;

first and second seal means disposed between said outer tubular member and said inner mandrel member in longitudinal spaced relation for providing respective fixed fluid seals with the substantially cylindrical surface of a first one of said members and for providing respective sliding fluid seals with the substantially cylindrical surface of the other one of said members;

the substantially cylindrical surfaces of said outer tubular member and said inner mandrel member and the first and second seal means defining an annular cavity having a substantially constant volume throughout coaxial movement of said inner mandrel member relative to said outer tubular member;

a quantity of fluid disposed within said annular cavity;

annular fluid metering housing means positioned within said annular cavity, having first and second end portions and inner and outer circumferential surfaces, for movement with the other one of said members relative to the first one of said members and to said annular cavity;

means for securing said annular fluid metering housing means to the other one of said members for movement therewith;

first fluid metering seal means for providing a fluid seal between said fluid metering housing means and the first one of said members;

second fluid metering seal means for providing a fluid seal between said fluid metering housing means and the other one of said members;

first fluid flow passage means in said fluid metering housing means for fluidly communicating the first and second end portions of said fluid metering housing means;

fluid flow restriction means in said first fluid flow passage means for alternately accelerating and decelerating a fluid stream passing therethrough in a direction from the first end portion toward the second end portion of said fluid metering housing means a plurality of times, thereby providing a predetermined resistance to fluid flow through said first fluid flow passage means;

second fluid flow passage means for fluidly communicating the first and second end portions of said fluid metering housing means; and check valve means in said second fluid flow passage means for blocking fluid flow through said second fluid flow passage means from the first end portion toward the second end portion of said metering housing means, and, alternately, for permitting substantially unrestricted fluid flow through said second fluid flow passage means from the second end portion toward the first end portion of said metering housing means.

4. The tool as defined in claim 3 wherein said quantity of fluid is a liquid.

5. The tool as defined in claim 3 wherein said fluid flow restriction means is characterized further to include:

a labyrinth passage comprising a plurality of pairs of spin chambers, each pair of spin chambers being interconnected by a respective interconnecting passage tangentially aligned with each of the spin chambers, and each of said spin chambers being connected to a spin chamber of another pair of spin chambers via a passage communicating between and at right angles to the central portions thereof.

6. The tool as defined in claim 3 wherein said first fluid metering seal means is characterized further to include:

an annular groove formed in said annular fluid metering housing means adjacent the substantially cylindrical surface of the first one of said members; and an annular resilient sealing member disposed in said annular groove in sealing mutual engagement between said annular fluid metering housing means and the substantially cylindrical surface of the first one of said members.

7. The tool as defined in claim 3 wherein said first fluid metering seal means is characterized further to include:

an annular groove formed in said annular fluid metering housing means adjacent the substantially cylindrical surface of the first one of said members;

a resilient annular seal member positioned within said annular groove and sealingly mutually engaging said annular fluid metering housing means and the substantially cylindrical surface of the first one of said members; and a substantially rigid backup ring positioned within said annular groove intermediate said annular resilient member and the second end portion of said annular fluid metering housing means and in sliding engagement with the substantially cylindrical surface of the first one of said members.

8. The tool as defined in claim 7 wherein:

said annular resilient seal member is an elastomeric O-ring; and said substantially rigid backup ring is constructed of reinforced Teflon.

9. The tool as defined in claim 3 wherein said annular fluid metering housing means is characterized further to include:

annular filter means mounted on the first end portion of said annular metering housing means intermediate said annular cavity and said fluid flow restriction means for filterng contaminants from fluid passing from said cavity therethrough to said fluid flow restriction means.

10. A tool comprising:

an outer tubular member having an inner surface at least a portion of which is substantially cylindrically shaped;

inner mandrel means, coaxially disposed within said outer tubular member and having an outer surface thereon at least a portion of which is substantially cylindrically shaped, for moving longitudinally coaxially relative to said outer tubular member in response to longitudinal manipulation thereof;

first and second seal means disposed between said outer tubular member and said inner mandrel means in longitudinal spaced relation for providing respective substantially fixed fluid seals with the inner surface of said outer tubular member and for providing respective sliding fluid seals with the substantially cylindrically shaped portion of the outer surface of said inner mandrel means;

the inner surface of said outer tubular member, the outer surface of said inner mandrel means and the first and second seal means defining a closed annular cavity having a substantially constant volume;

a quantity of fluid disposed within said annular cavity;

annular fluid metering housing means positioned within said annular cavity, having first and second end portions and inner and outer circumferential surfaces for movement with said inner mandrel means relative to said outer tubular member;

means for securing said annular fluid metering housing means to said inner mandrel means to facilitate movement of said fluid metering housing means with said inner mandrel means relative to said fluidcontaining annular cavity;

first fluid metering seal means for providing a sliding fluid seal between said fluid metering housing means and the substantially cylindrically shaped position of the inner surface of said outer tubular member;

second fluid metering seal means for providing a fluid seal between said metering housing means and the outer surface of said inner mandrel means;

first fluid flow passage means in said fluid metering housing means for fluidly communicating the first and second end portions of said fluid metering housing means;

fluid flow restriction means interposed in said first fluid flow passage means for providing a predetermined resistance to fluid flow through said first fluid flow passage means when said inner mandrel means is moved in a first longitudinal direction relative to said outer tubular member;

second fluid flow passage means in said fluid metering housing means for communicating the first and second end portions of said fluid metering housing means; and check valve means in said second fluid flow passage means for blocking fluid flow through said second fluid flow passage means when said inner mandrel means is moved in the first longitudinal direction relative to said outer tubular member, and, alternately, for passing substantially unrestricted fluid flow through said second fluid flow passage means when said inner mandrel means is moved in a second longitudinal direction, opposite to said first longitudinal direction, relative to said outer tubular member.

11. The tool as defined in claim 10 characterized further to include:

a radial end face on said inner mandrel means facing in the first longitudinal direction of movement of said inner mandrel means;

port means in said outer tubular member proximate said radial end face of said inner mandrel means for providing communication between the exterior and interior of said outer tubular member; and annular seal means mounted in said outer tubular member in coaxial alignment with said radial end face of said inner mandrel means for providing selective sealing engagement between said radial end face of said inner mandrel means and said tubular outer member when said inner mandrel means is moved in the first longitudinal direction of movement into sealing contact therewith to thereby close said port means, and, alternately, for disengaging from said radial end face of said inner mandrel means when said inner mandrel means is moved in the second longitudinal direction opposite said first longitudinal direction of movement to thereby open said port means.

12. The tool as defined in claim 11 characterized further to include:

means mutually engaging said outer tubular member and said inner mandrel means for restricting relative rotational movement between said outer tubular member and said inner mandrel means.

13. The tool as defined in claim 11 wherein said annular seal means is characterized further to include:

a resilient annular portion in coaxial alignment with said radial end face of said inner mandrel means.

14. The tool as defined in claim 13 characterized further to include:

annular rib means formed on said radial end face of said inner mandrel means for sealingly engaging said resilient annular portion of said annular seal means; and annular rib means mounted on said outer tubular member and coaxially aligned with and facing toward said annular rib means of said radial end face for sealingly engaging said resilient annular portion of said annular seal means.

15. The tool as defined in claim 14 wherein:

said inner mandrel means is characterized further to include a longitudinal passage through the entire length thereof; and said tool is characterized further to include:

annular piston means disposed about said inner mandrel means and within said outer tubular member intermediate said annular cavity and said radial end face of said inner mandrel means for moving longitudinally relative to said outer tubular member; and means responsive to a pressure within said passage through said inner mandrel means greater than a simultaneous pressure applied to said port means when said port means is closed for applying the pressure within said inner mandrel means via said annular piston means to said radial end face of said inner mandrel means to thereby reinforce the sealing engagement between said radial end face of said inner mandrel means and said tubular outer member provided by said annular seal means.

16. The tool as defined in claim 15 wherein said means responsive to a pressure within said passage is characterized further to include:

port means in said inner mandrel means for communicating pressure therewithin to the end of said annular piston means nearest said annular cavity; and means for releasably retaining said annular piston means in a position preventing application of pressure within said inner mandrel means to said radial end face of said inner mandrel means and, alternately, for releasing said annular piston means to apply pressure within said inner mandrel means via said annular piston means to said radial end face of said inner mandrel means when the pressure within said inner mandrel means exceeds the pressure applied to said port means when said port means is closed by a predetermined amount.

17. The tool as defined in claim 10 characterized further to include:

longitudinal spline means interconnecting said inner mandrel means and said outer tubular member for preventing relative rotation therebetween and permitting torque to be transferred therebetween.

* * * * *